US010233754B2

(12) United States Patent
Legris

(10) Patent No.: US 10,233,754 B2
(45) Date of Patent: Mar. 19, 2019

(54) HYDRAULIC ROCK FRACTURING DEVICE

(71) Applicant: Guy Legris, Sudbury (CA)

(72) Inventor: Guy Legris, Sudbury (CA)

(73) Assignee: 2516139 ONTARIO INC., Ontario (CA)

( * ) Notice: Subject to any disclaimer, the term of this patent is extended or adjusted under 35 U.S.C. 154(b) by 0 days.

(21) Appl. No.: 15/263,436

(22) Filed: Sep. 13, 2016

(65) Prior Publication Data

US 2017/0342833 A1 Nov. 30, 2017

(30) Foreign Application Priority Data

May 31, 2016 (CA) ..... 2931723

(51) Int. Cl.
*E21C 37/10* (2006.01)
*E21C 41/26* (2006.01)

(52) U.S. Cl.
CPC ..... *E21C 37/10* (2013.01); *E21C 41/26* (2013.01)

(58) Field of Classification Search
CPC ..... E21C 37/06; E21C 37/10
USPC ..... 166/179, 187
See application file for complete search history.

(56) References Cited

U.S. PATENT DOCUMENTS 1,630,470 A * 5/1927 Clifford ..... E21C 37/10 166/308.1
4,657,306 A * 4/1987 Koopmans ..... E21C 37/10 299/21
4,711,501 A * 12/1987 Maeda ..... E21C 37/10 166/187
5,398,998 A * 3/1995 Evans ..... E21C 37/10 299/21
6,305,753 B1 10/2001 Rodrigues

FOREIGN PATENT DOCUMENTS

EP 0225415 A1 6/1987

* cited by examiner

*Primary Examiner* — David J Bagnell
*Assistant Examiner* — Michael A Goodwin
(74) *Attorney, Agent, or Firm* — Schmeiser, Olsen & Watts, LLP

(57) ABSTRACT

A rock fragmentation device and method is provided which includes a shaft and a plurality of expandable members positioned along a length thereof. The shaft has a hollow length therethrough for the passage of a pressurized fluid, and a plurality of feed apertures for delivery of the pressurized fluid to the expandable members. The shaft further includes a feed inlet for receiving the pressurized fluid from a hydraulic system. The plurality of expandable members each have an inner diameter dimensioned to receive the shaft in a tightly engaging connection, and are positioned on the shaft in fluid tight engagement effective for receiving pressurized fluid via the feed apertures without leaking fluid. The expandable members are expandable, upon filling with the pressurized fluid, to sufficient dimensions to break apart rock when fitted inside a cavity formed therein.

9 Claims, 3 Drawing Sheets

HYDRAULIC ROCK FRACTURING DEVICE

CROSS-REFERENCE TO RELATED APPLICATION

This application claims priority to Canadian Patent Application Serial No. 2,931,723 having a filing date of May 31, 2016, the entire contents of which are hereby incorporated by reference.

FIELD OF TECHNOLOGY

The following relates to rock fragmentation methods and devices that can be used in such methods. In particular, the following relates to a hydraulic device which includes a plurality of expandable members for breaking apart rock, and a method of use thereof.

BACKGROUND

The controlled demolition or fragmentation of rocks has often been performed with explosives. The resulting noise, dust, vibrations and possible flying debris is detrimental not only to the safety of personnel, but also to the environment. In addition, the dangers of storing and handling explosives and the extensiveness of personnel training contributes to the undesirability of using this methodology.

In recent years, non-explosive fragmentation methods have been developed. These methods typically involve drilling cavities into the rock to be fragmented and filling the cavities with a slurry which incorporates a non-explosive demolition agent. The agent expands over time and eventually fragments the rock. However, these methods can be difficult to practice and are often ineffective. For instance, if horizontal cavities are drilled, care must be taken to ensure that the slurry does not leak out. Furthermore, if there are crevices in the rock, the fluid can leak into the crevices and not provide the necessary pressure to fragment the stone. Also, since the expansion of the slurry occurs through a chemical reaction the process can work quite slowly, often in narrow temperature and humidity ranges. Moreover, since the slurry can only be used once, new batches must be used in every rock demolition.

It is therefore desirable to provide new methods and devices that can be used for rock fragmentation, especially those which can be used in residential and business areas, or other areas in which restrictions might be placed on noise, ground vibrations, air blasts, dust or other drawbacks associated with the use of explosives.

SUMMARY

An aspect relates to an improved device and method for fragmentation of rock. Accordingly, there is provided herein a rock fragmentation device comprising:

a shaft having a hollow length therethrough for the passage of a pressurized fluid, and a plurality of feed apertures for delivery of the pressurized fluid, said shaft further comprising a feed inlet for receiving said pressurized fluid from a hydraulic system; and a plurality of expandable members each having an inner diameter dimensioned to receive the shaft therein in a tightly engaging connection therebetween, the plurality of expandable members being positioned on the shaft in fluid tight engagement effective for receiving said pressurized fluid via said feed apertures without discharging fluid to an exterior thereof;

wherein the expandable members are expandable, upon filling with said pressurized fluid, to sufficient dimensions to fragment a rock when fitted inside a cavity formed therein.

According to certain embodiments of the rock fragmentation device, each expandable member may comprise a molded elastic rubber tube including sidewalls and top and bottom walls each having a central aperture, the central aperture having a diameter for receiving the shaft therein with a tightly engaging connection therebetween; and a joint seal molded into the top and bottom walls of the elastic rubber tube, tightly sealing the central aperture to the shaft. Preferably, each expandable member will further comprise at least one disk member, also comprising a central aperture having a diameter for receiving the shaft, more preferably two disk members, each positioned on either side of the molded elastic rubber tube to strengthen the expandable members and prevent expansion of the elastic rubber tube axially along the length of the rock fragmentation device.

In further embodiments, the lower and upper ends of the shaft respectively may comprise lower and upper sleeves, or securing elements, which maintain the plurality of expandable members in tightly connected engagement, at least one of said sleeves being removable. In one non-limiting example, the upper sleeve may comprise two nuts and a washer, which thread onto the shaft and tightly hold the expandable members in place.

In further embodiments of the fragmentation device, the outer diameter of the plurality of expandable members may be dimensioned to be about 2 times the outer diameter of the shaft. Further, the rock fragmentation device may be fabricated with materials effective to withstand pressures of up to about 50,000 psi, without leakage of the pressurized fluid.

In other embodiments, the rock fragmentation device may comprise from 3 to 10 expandable members, preferably about 6 expandable members. In addition, there may be just one, or a plurality of feed apertures positioned within each of said expandable members.

Also provided herein is a rock fragmentation apparatus comprising a rock fragmentation device as described herein; and a hydraulic system for feeding pressurized fluid to the rock fragmentation device via the feed inlet.

Also provided herein is a method of fragmenting rock, the method comprising steps of:

drilling or forming at least one cavity in a rock;

inserting a rock fragmentation device as described herein into the at least one cavity; and feeding pressurized fluid to the expandable members of the rock fragmentation device using a hydraulic system, via said plurality of feed apertures, thereby expanding the plurality of expandable members with pressurized fluid until the rock fractures.

BRIEF DESCRIPTION

Some of the embodiments will be described in detail, with reference to the following figures, wherein like designations denote like members, wherein.

DETAILED DESCRIPTION

Described herein is a hydraulic rock fragmentation device and methods for the use thereof. It will be appreciated that the embodiments and examples of the device and methods described herein are for illustrative purposes intended for those skilled in the art and are not meant to be limiting in any way.

In the context of the present disclosure, the term "rock" is intended to encompass, without limitation, natural rock and stone, artificial rock and stone, concrete and cement, including concrete and cement with reinforcing bars.

Figure 1:
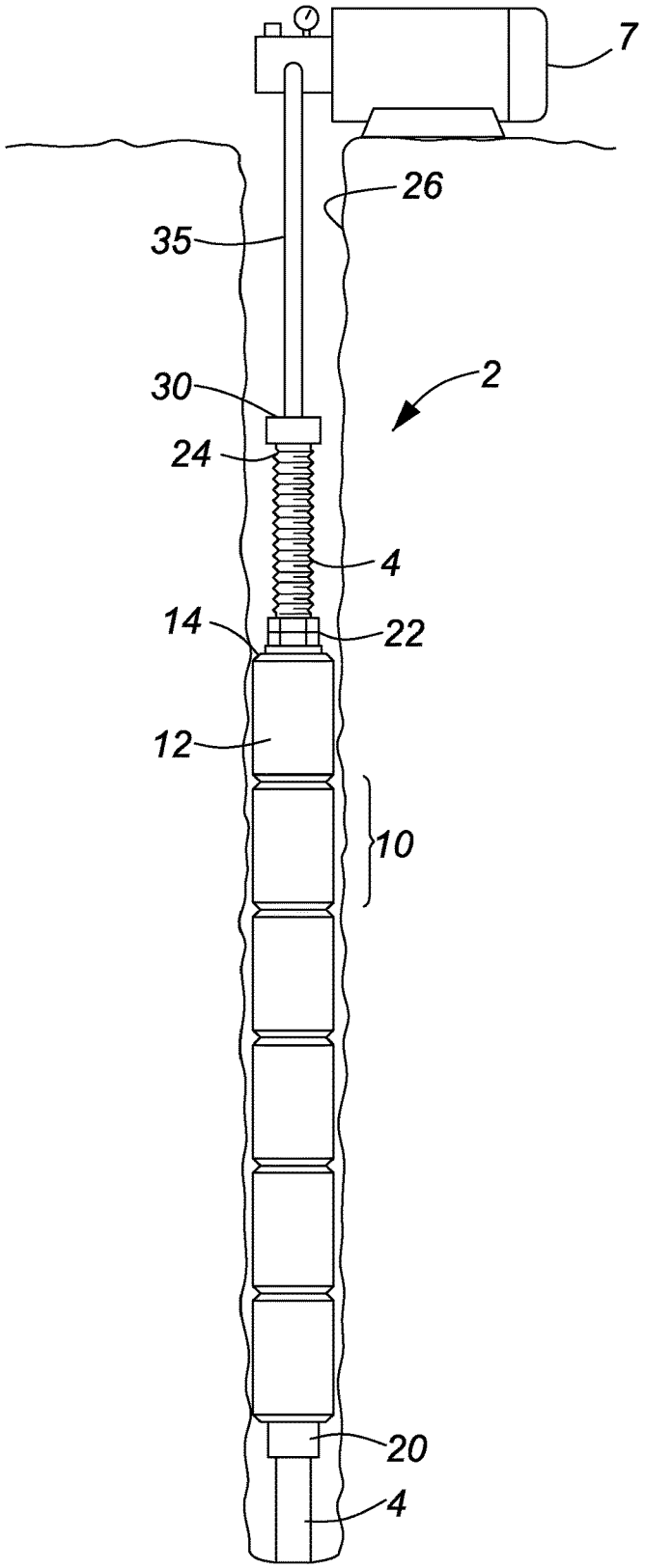
FIG. 1 shows a front view of an embodiment of a hydraulic rock fragmentation device comprising six expandable members in accordance with one possible embodiment of the present invention.
Figure 2A:
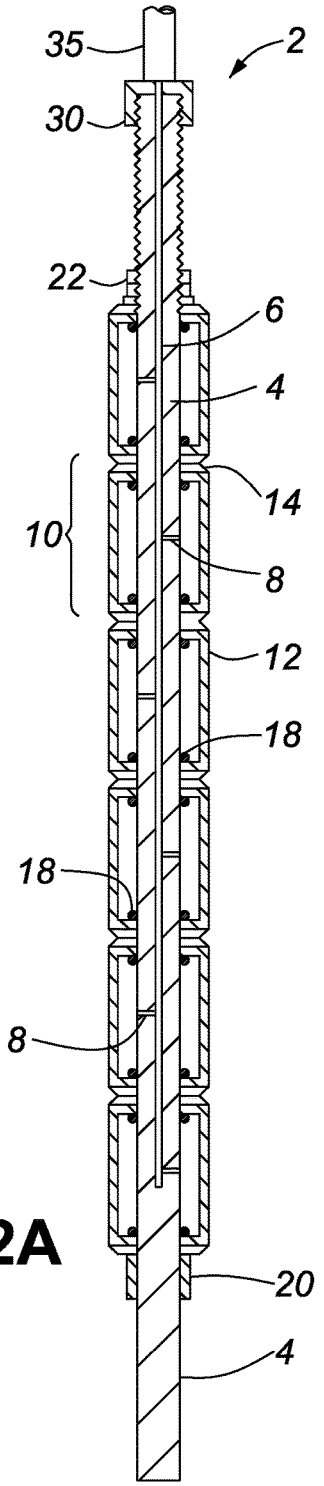
FIG. 2A shows a cross-sectional view of an embodiment of the hydraulic rock fragmentation device illustrated in FIG. 1.
Figure 2B:
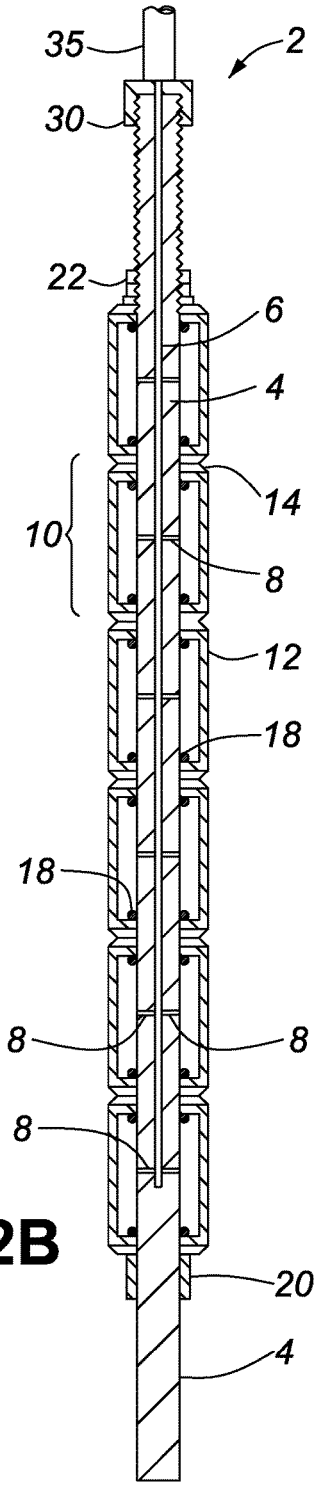
FIG. 2B shows a cross-sectional view of a further embodiment of the hydraulic rock fragmentation device illustrated in FIG. 1.
Figure 3:
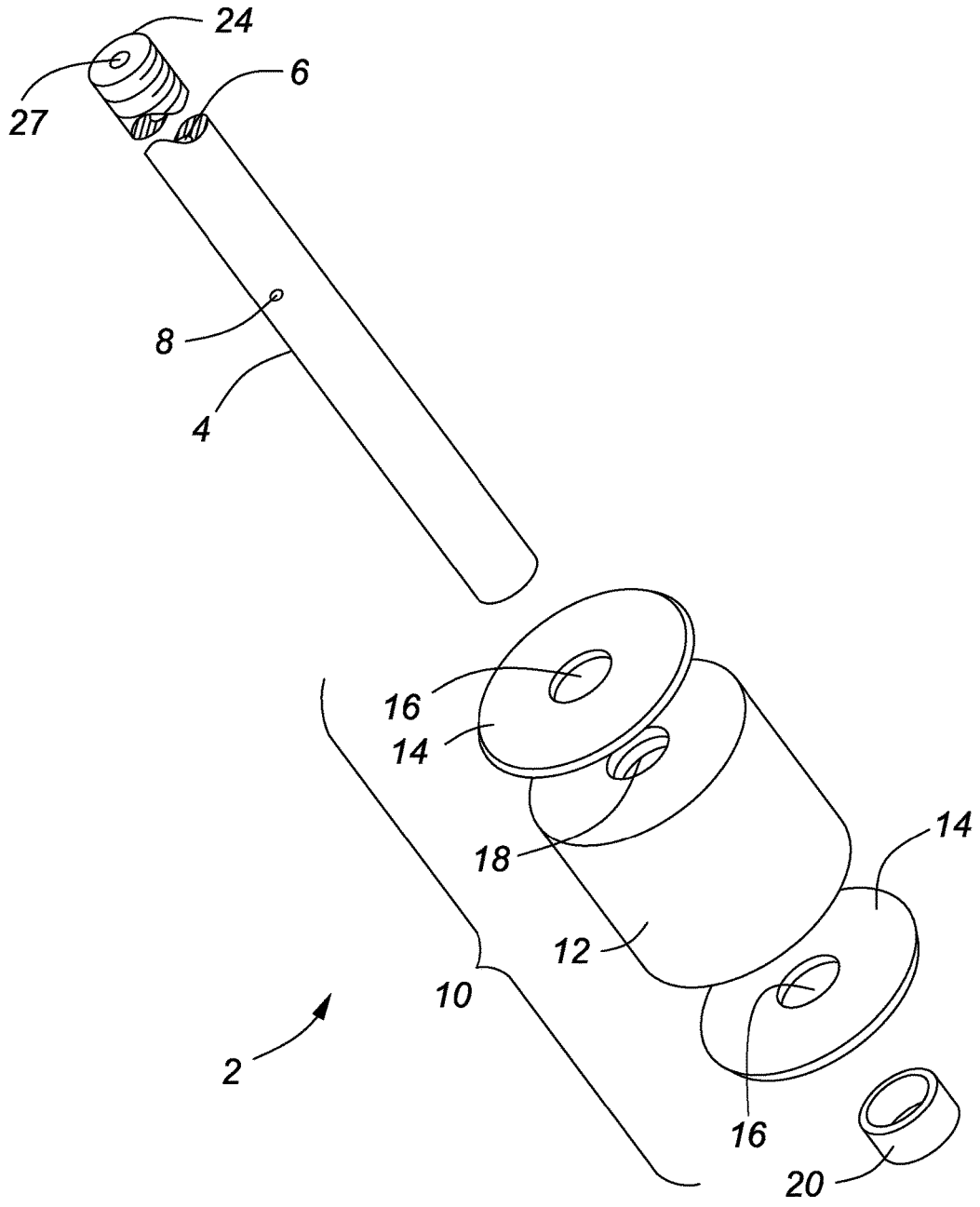
FIG. 3 shows an exploded view of a portion of the embodiment of the hydraulic rock fragmentation device illustrated in FIG. 1, showing the individual elements of an expandable member.

FIGS. 1-3 illustrate one possible embodiment of a hydraulic rock fragmentation device 2. As illustrated, the device includes a shaft 4 having a hollow length 6 therethrough for the passage of a pressurized fluid, feed apertures 8 for the delivery of the pressurized fluid, and a plurality of expandable members 10 mounted along the shaft 4. The plurality of expandable members 10 have an inner diameter for receiving the shaft therein in a tightly engaging connection and are positioned on the shaft 4 for receiving the pressurized fluid emerging from the feed apertures 8 without discharging the fluid to the exterior. In FIGS. 1 and 2, six expandable members 10 mounted on the shaft 4 are depicted, although the number of the expandable members can be varied. In one example, which is non-limiting and provided for illustration purposes, the shaft 4 is about 1¼ inches in diameter and the hollow length 6 has a diameter of about ⅜ inches. For increased durability and strength, the shaft is made from metal, however, other materials that have sufficient durability and strength can be used. For example, hardened steel, titanium or another material that can bear 50,000 psi of pressure might be used in certain embodiments.

As illustrated in FIGS. 2 and 3, the expandable members 10 can be made from a molded rubber tube 12 including sidewalls, and top and bottom walls each having a central aperture 16. The central aperture 16 has a diameter which is dimensioned to receive the shaft with a tightly engaging connection. Preferably, each expandable member will further comprise at both ends a disk member 14 which also has a central aperture having similar dimensions as the central aperture 16 of the expandable member 10. A variety of different dimensions for these components can be envisioned. In one particular non-limiting embodiment, the rubber tubes are 4 inches long and have a diameter of about 2¾ inches. In this configuration, the rubber tubes 12 will be fabricated using an elastomer that can withstand high pressures, e.g. up to about 40,000 psi, preferably about 50,000 psi, without rupturing. In this non-limiting embodiment, the disk member 14 may be a hardened steel washer with, for example, a width of about ¼ inches and a diameter of about 2⅝ inches. In one possible embodiment, which is non-limiting, it is contemplated that the disk members 14 can be sealed onto the top and bottom walls of the rubber tube 12 with a high intensity adhesive that can maintain the bond between the two materials at high pressures, e.g. up to about 40,000 psi, preferably about 50,000 psi. In addition, the expandable member 10 comprises joint seals 18, as can be seen in FIGS. 2 and 3, which facilitate the formation of a tight seal between the shaft 4 and the central aperture 16 of the rubber tube 12 and disk members 14. An example of the joint seal is an "O"-ring or gasket. The joint seal 18 is preferably molded into the rubber tube on the inside of the space formed by the expandable member 10, such that the joint seal can prevent leakage of fluid from the expandable member 10 to the exterior. The joint seal 18 may be made from any material that is suitable for maintaining a tight seal, for example but without being limiting, various elastomers. The joint seal 18 may alternatively be adhered to the central aperture 16 of the rubber tube 12 using a high intensity adhesive that can maintain the bond between the two materials at the high pressures required of the device. The central aperture 16 and the joint seal 18 each have an inner diameter which is dimensioned such that a tight seal forms with the shaft 4 when the expandable member 10 is mounted on the shaft 4.

In the embodiment illustrated, the lower and upper ends of the shaft 4 include, respectively, a lower and upper sleeve for pressing together the plurality of expandable members 10. FIGS. 1-3 depict a lower sleeve 20 and an upper sleeve 22. The lower sleeve 20 supports the plurality of expandable members 10 and prevents the expandable members 10 from sliding off the shaft 4. The upper sleeve 22 is above the uppermost expandable member 10 and prevents the upward movement of the expandable members 10 on the shaft 4. The lower sleeve 20 may be secured to the shaft 4 by welding, hydraulic threads, or by any other means that securely attaches the lower sleeve 20 to the shaft 4. In certain embodiments the upper sleeve 22 can be removably secured to the shaft 4 to allow for mounting and demounting the expandable members 10 on and from the shaft 4, for example through a nut and bolt connection or any other connection that is not-permanent. For example, in an embodiment, the upper sleeve 22 may take the form of a nut (or plurality of nuts), fastened to the shaft 4 via hydraulic threads formed at least on the top (e.g. about 6" from the top) portion of the shaft 4, with one or more washers positioned between the upper sleeve 22 and the top expandable member 10. The washer and nuts thus can hold the expandable members 10 tightly together and in place, while also facilitating convenient removal for servicing or replacement of the expandable members 10. The lower and upper sleeves, 20 and 22, tightly press together the plurality of expandable members longitudinally ensuring that adjacent disk members 14 and adjacent joint seals 18 are tightly pressed against each other, further decreasing the likelihood of leaks. By this pressing action, the lower and upper sleeves, 20 and 22, also prevent the expansion of the expandable members 10 longitudinally along the shaft 4 and ensures that the expansion of the expandable members 10 occurs outwardly toward the rock face 26. This results in a uniform expansion along the entire length of the hydraulic rock fragmentation device 2 and maximum contact of the expandable members 10 with the rock face 26.

A hydraulic system 7 is connected to the upper end 24 of the shaft 4 via a feed inlet 27 to provide the pressurized fluid for expanding the expandable members 10. The use of any hydraulic system known in the art is contemplated. Without being limiting in any way, the pressurized fluid that is used in the system will advantageously be biodegradable, free of heavy metals, non-toxic and recyclable. This increases the safety for personnel and also protects the environment in case of leakage. For example and without being limiting, the pressurized fluid may be vegetable-based.

In one possible embodiment of the hydraulic rock fragmentation device 2, the outer diameter of the plurality of expandable members 10 may be about twice the outer diameter of the shaft 4. For example and without intending to be limiting in any way, the outer diameter of the shaft 4 may be about 1¼ inches and the outer diameter of the expandable members 10 may be about 2¾ inches. However, the dimensions of the apparatus may vary depending on the hardness of the rock, the amount of pressure required to fracture the rock, and the size of the rock.

Also provided herein is an apparatus for hydraulically fragmenting rock, which includes the hydraulic rock fragmentation device 2, and a hydraulic system capable of operating under high pressures, e.g. up to 40,000 psi, preferably up to 50,000 psi, without leakage of the pressurized fluid to the exterior. The ability of the system to withstand this pressure enables the use of the device in hard rock applications, (e.g. granite, volcanic rock or quartzite). Pressure couplings or another high pressure fitting 30 may be used to connect the piping 35 of the hydraulic system to the device 2. A system of valves may also be used to allow the user to pressurize the shaft 4 and expandable members 10, and to release the pressure in the system when the device is not in use so that the hydraulic fluid can flow back to the hydraulic fluid reservoir (not shown).

In different embodiments, the hydraulic rock fragmentation device 2 may comprise any number of expandable members 10, although this will typically be from 3 to 10. As many expandable members 10 can be mounted on the shaft 4 as is desired/required in order to obtain the necessary pressure and/or surface area facing the rock wall 26 needed to fracture the rock. For example, the hydraulic rock fragmentation device 2 may comprise 6 expandable members as illustrated in FIGS. 1-3.

In a non-limiting example of the configuration shown in FIG. 1, the shaft 4 may be approximately 3 feet in length, with about 2 feet along this length being fitted with expandable members 10. A cavity is drilled in the rock to about a 4 foot depth, and the device 2 is inserted directly into the bottom of the cavity. About 6 inches of the shaft 4, including lower sleeve 20, extends from the bottom of the expandable members 10, while another 6 inches of the shaft 4, including upper sleeve 22, extends from the top of the expandable members 10.

The advantages for using of a plurality of expandable members rather than a single large expandable member are numerous. For instance, this may include the benefit of only having to replace one of the expandable members 10 if there is a rupture, which reduces maintenance costs. Also, it is advantageous to have a uniform expansion along the entire length of the shaft. The strength of the device is also increased by using shorter expansion lengths, since shorter rubber lengths will have a lower likelihood of splitting/rupturing.

In certain embodiments, as illustrated in FIG. 2B, a plurality of the feed apertures 8 may be located within each of the expandable members 10. Thus, while one feed aperture is required to deliver pressurized fluid to an expandable member 10, it is envisioned that including two or more feed apertures 8 for each expandable member 10 will be advantageous in certain embodiments. The feed apertures may also be arranged in various configurations on the shaft 4. For example, the feed apertures 8 may be arranged on the same longitudinal plane of the shaft 4, or can alternate between opposite longitudinal planes of the shaft 4. In certain non-limiting embodiments, adjacent feed apertures 8 will be diametrically opposed to each other, with one feed aperture 8 positioned in the middle of each expandable member 10. For instance, the feed apertures 8 may be offset and spaced about 4.4 inches from each other. In one particular non-limiting embodiment, the feed holes 8 may be about ⅛ inches in diameter.

The present disclosure also provides for a method of fragmenting rock using a hydraulic rock fragmentation device 2 as described herein. The method comprises first drilling a cavity or cavities in the rock to be fragmented at predetermined intervals. The location, number and depth of the cavities is determined by one of skill in the art. A hydraulic rock fragmentation device 2 is then inserted into the cavity or cavities. The hydraulic rock fragmentation device 2, as already described, comprises a shaft 4 having a hollow length 6 for the passage of pressurized fluid, feed apertures 8 for the delivery of the pressurized fluid, and a plurality of expandable members 10 having an inner diameter for receiving the shaft 4 therein in a tightly engaging connection there between. The plurality of expandable members 10 are positioned on the shaft 4 to receive the pressurized fluid emerging from the feed apertures 8 without discharging the fluid to the exterior. It is advantageous for the hydraulic rock fragmentation device 2 to fit snugly into the cavity so that any expansion of the expandable members 10 will push directly against the rock face. The plurality of expandable members are then expanded with pressurized fluid until the rock fractures. This process is repeated as many times as are needed to fragment the rock to a suitable size, e.g. for transport or other use. If desired, more than one device 2 can be used in parallel to break more than one rock or multiple sections of the same rock, by connecting the devices together with a system of valves as would otherwise be apparent to those of skill in the art.

One or more currently preferred embodiments have been described by way of example. It will be apparent to persons skilled in the art that a number of variations and modifications can be made without departing from the scope of the invention as defined in the claims.

It should be noted that the term "comprising" does not exclude other elements or steps and the use of articles "a" or "an" does not exclude a plurality. Also elements described in association with different embodiments may be combined. It should also be noted that reference signs in the claims should not be construed as limiting the scope of the claims.

What is claimed is:

1. A rock fragmentation device comprising:

a shaft having a hollow length therethrough for the passage of a pressurized fluid, and a plurality of feed apertures for delivery of the pressurized fluid, said shaft further comprising a feed inlet for receiving said pressurized fluid from a hydraulic system; and a plurality of expandable members each having an inner diameter dimensioned to receive the shaft therein, the plurality of expandable members being positioned on the shaft in fluid tight engagement effective for receiving said pressurized fluid via said feed apertures without discharging fluid to an exterior thereof;

wherein the expandable members are expandable, upon filling with said pressurized fluid, to sufficient dimensions to fragment a rock when fitted inside a cavity formed therein;

wherein each of the plurality of expandable members comprise:

a molded elastic rubber tube including sidewalls, a top wall, and a bottom wall, each of the top wall and the bottom wall having a central aperture, the central aperture having a diameter for receiving the shaft therein;

a plurality of disk members, each disk member comprising a central aperture dimensioned to receive the shaft, at least one disk member of said plurality of disk members positioned on either side of the molded elastic rubber tube and sealed onto the molded elastic rubber tube; and a joint seal molded into each of the top wall and the bottom wall of the elastic rubber tube, sealing the central aperture of the top wall and the bottom wall to the shaft.

2. The rock fragmentation device of claim 1, wherein lower and upper ends of the shaft respectively comprise lower and upper sleeves which maintain the plurality of expandable members in connected engagement, at least one of said sleeves being removable.

3. The rock fragmentation device of claim 1, wherein an outer diameter of the plurality of expandable members is dimensioned to be 2 times an outer diameter of the shaft.

4. The rock fragmentation device of claim 1, wherein the rock fragmentation device comprises from 3 to 10 expandable members.

5. The rock fragmentation device of claim 4, wherein the rock fragmentation device comprises 6 expandable members.

6. The rock fragmentation device of claim 1, wherein a plurality of said feed apertures are positioned within each of said expandable members.

7. The rock fragmentation device of claim 1, wherein one of said feed apertures is positioned within each of said expandable members.

8. A rock fragmentation apparatus comprising:

a rock fragmentation device as defined in claim 1; and a hydraulic system for feeding pressurized fluid to said rock fragmentation device via said feed inlet thereof.

9. A method of fragmenting rock comprising:

drilling or forming at least one cavity in a rock;

inserting a rock fragmentation device as defined in claim 1 into the at least one cavity; and feeding pressurized fluid to the expandable members of the rock fragmentation device using a hydraulic system, via said plurality of feed apertures, thereby expanding the plurality of expandable members with pressurized fluid until the rock fractures.

* * * * *